United States Patent [19]

Ceccucci, Jr.

[11] Patent Number: 5,003,848

[45] Date of Patent: Apr. 2, 1991

[54] MECHANICAL TOOL FOR MANIPULATING FITTINGS AND CAPS

[76] Inventor: Rudolph R. Ceccucci, Jr., 66 Third St., Cohoes, N.Y. 12047

[21] Appl. No.: 542,023

[22] Filed: Jun. 22, 1990

[51] Int. Cl.[5] ..... B25B 13/16

[52] U.S. Cl. ..... 81/176.2; 294/19.1; 81/176.3; 81/3.4; 81/65

[58] Field of Search ..... 81/176.2, 176.5, 176.1, 81/176.3, 3.4, 3.41, 427, 64–65, 90.1; 294/19.1, 99.1

[56] References Cited

U.S. PATENT DOCUMENTS

| | | | |
|---|---|---|---|
| 40,271 | 10/1863 | Lilley | 294/19.1 |
| 144,827 | 11/1873 | Bucklin, Jr. . | |
| 154,445 | 8/1874 | Beecher . | |
| 729,672 | 6/1903 | Sack . | |
| 741,082 | 10/1903 | Thompson . | |
| 922,258 | 5/1909 | Caven . | |
| 1,040,982 | 10/1912 | Ingerham . | |
| 1,352,638 | 9/1920 | Thompson . | |
| 1,756,357 | 4/1930 | Hilmer | 294/19.1 X |
| 1,932,147 | 10/1933 | Sabatine . | |
| 2,575,779 | 11/1951 | Young . | |
| 2,616,741 | 11/1952 | Ziese | 294/19.1 |
| 2,640,382 | 6/1953 | Grossman . | |
| 2,676,505 | 3/1950 | Goodnight . | |
| 3,006,063 | 10/1961 | Linan | 81/427 X |
| 3,231,955 | 8/1964 | Taylor . | |
| 4,573,378 | 3/1986 | McDonald . | |

OTHER PUBLICATIONS

Master 1989 Camping World, Camping World, Inc., p. 103, 1989.

*Primary Examiner*—D. S. Meislin

*Attorney, Agent, or Firm*—Heslin & Rothenberg

[57] ABSTRACT

A mechanical tool for facilitating coupling and decoupling of home fittings and caps to a plumbing outlet, such as septic drain outlet on a recreational vehicle is disclosed. The tool includes a handle and two opposed branches extending from one end thereof. The free end of each branch has a slot therein sized to engageably receive one of the two diametrically opposed outwardly projecting lugs existing on a conventional drain hose fitting or drain cap. The branches are roughly spaced such that when in use the slotted free ends of the branches are capable of being adjusted to engagably receive the lugs. An adjustable biasing member suspended between the branches and a position so its not to interfere with the operation of the tool when used to manipulate the fitting or cap. The biasing member allows the tool to be appropriately tensioned such that the branches securely engage the fitting or cap when in use.

7 Claims, 3 Drawing Sheets

MECHANICAL TOOL FOR MANIPULATING FITTINGS AND CAPS

BACKGROUND OF THE INVENTION

1. Technical Field

The present invention relates generally to mechanical tools and, more particularly, to tools for facilitating coupling and decoupling of hose fittings and caps to a plumbing outlet, such as a septic drain outlet on a recreational vehicle.

2. Description of the Prior Art

Recreational vehicles, for example motorized homes and travel trailers, conventionally have one or more septic holding tanks, and a drain outlet therefrom located on the underside of the vehicle. Before draining the vehicle's holding tank(s), a drain cap positioned over the drain outlet must be removed and a drain hose, with an appropriate fitting at its end, must be securely connected thereto. The drain cap and hose fitting typically have diametrically opposed lugs or ears projecting therefrom to facilitate the desired manual connection/-disconnection to the outlet. In some cases, e.g., because of road grit, significant pressure and torque must be applied to the cap or fitting to effectuate the desired manipulation.

Should the hose be improperly attached to the drain fitting then a leak around the connection may result or, in a worst case scenario, the drain hose may become disconnected from the drain outlet resulting in discharge of the holding tank contents onto the ground. Because of the location of the drain outlet, connection and disconnection of the drain hose thereto is often a difficult operation. For example, it is frequently necessary for an individual to physically lay on the ground under the vehicle to make the desired connection/disconnection and it is almost always necessary for the individual to physically handle the drain fitting and cap. Thus, a mechanical tool capable of facilitating manipulation of the drain cap and connection of the drain hose to the septic drain outlet of a recreational vehicle offers significant benefits and commercial potential.

SUMMARY OF THE INVENTION

Briefly described, the manipulation tool of the present invention includes a handle which has two opposed branches extending from one end thereof. The free end of each branch has a slot therein sized to engagably receive one of the two diametrically opposed outwardly projecting lugs present on the drain fitting or cap to be manipulated. The branches are roughly spaced such that when in use the slotted free ends of the branches are capable of being adjusted to engagably receive the lugs. An adjustable biasing member is disposed between the branches in a position so as not to interfere with the operation of the tool when used to manipulate the drain hose fitting or drain cap. The adjustable biasing member allows the tool to be appropriately tensioned such that the branches securely engage the fitting or cap when in use.

Accordingly, a principal feature of the mechanical tool of the present invention is its ability to facilitate the connection or disconnection of a hose fitting or cap to a drain outlet of a recreational vehicle. Further, the tool is preferably of sufficient length to allow performance of the hose connection and disconnection operation from the side of the vehicle without requiring that the individual be positioned on the ground underneath the vehicle. The tool also assists in the application of pressure and torque to the fitting or cap.

BRIEF DESCRIPTION OF THE DRAWINGS

These and other objects, advantages and features of the present invention will be more readily understood from the following detailed description of certain preferred embodiments of the present invention, when considered in conjunction with the accompanying drawings in which.

DETAILED DESCRIPTION OF THE INVENTION

Figure 1:
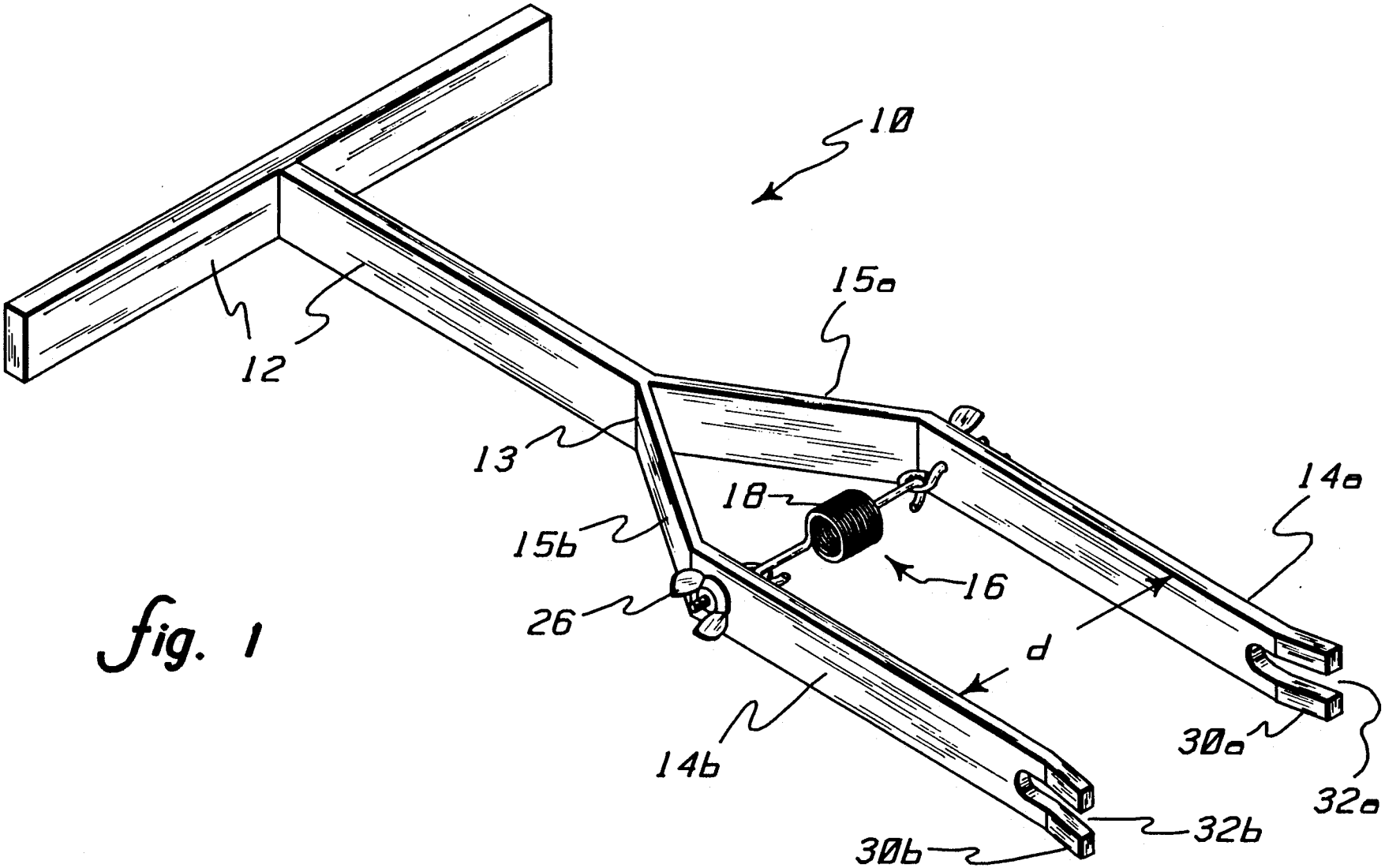
FIG. 1 is a perspective view of one embodiment of the mechanical tool of the present invention.
Figure 2:
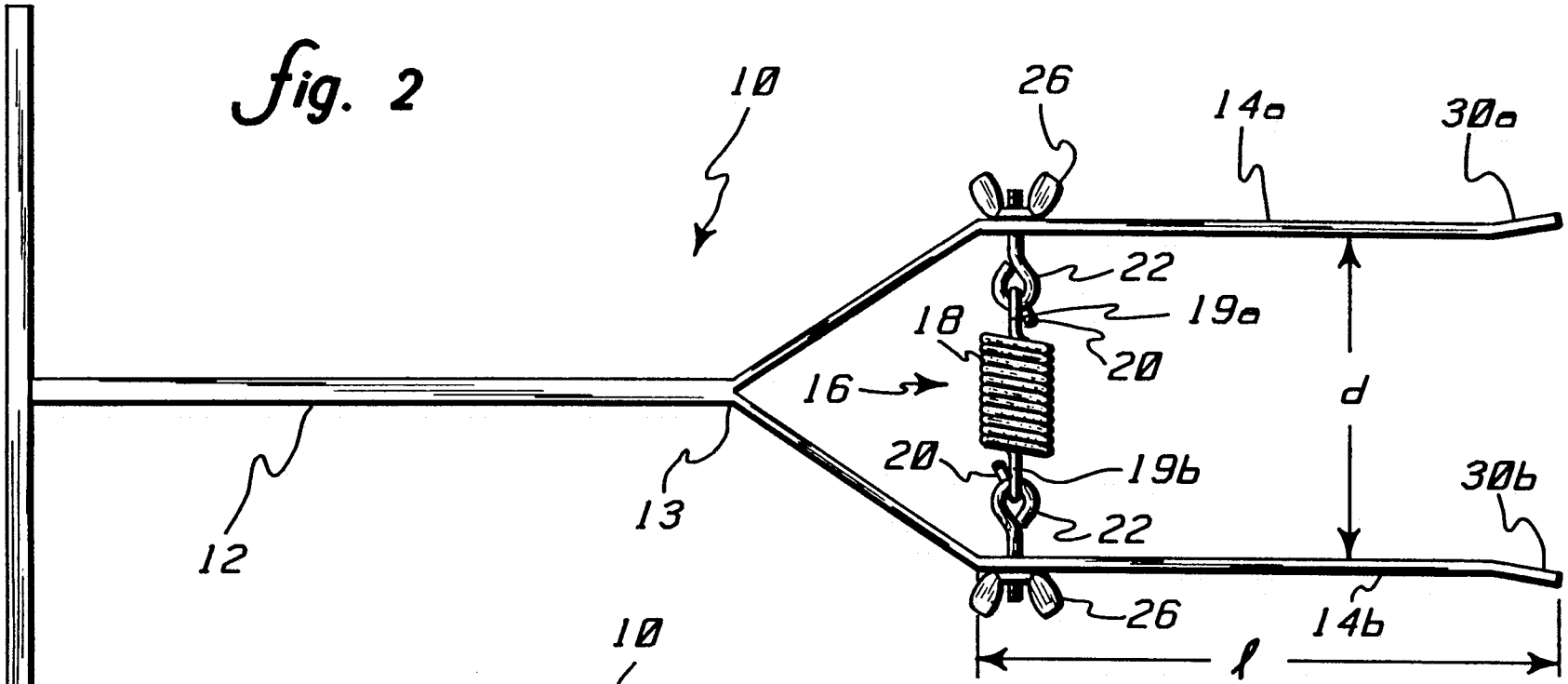
FIG. 2 is top plan view of the tool embodiment of FIG. 1.
Figure 3:
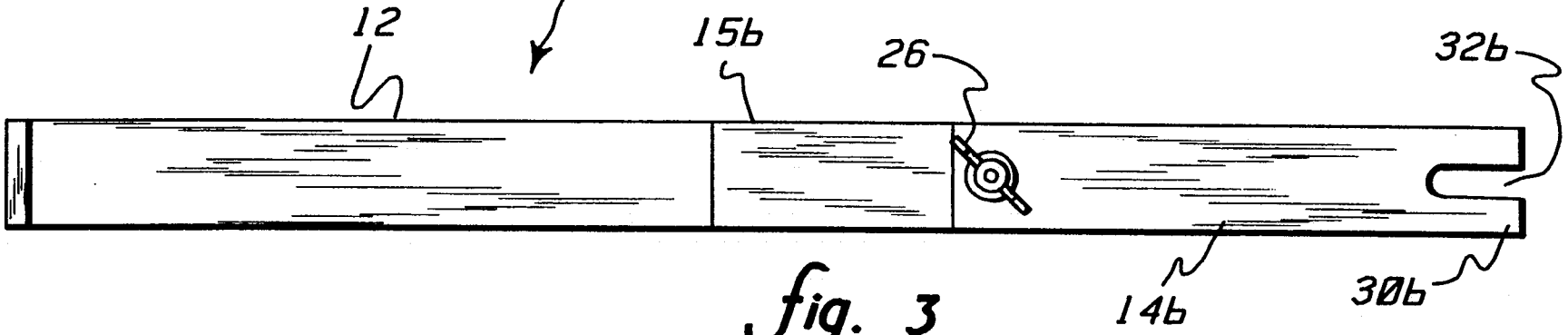
FIG. 3 is a side elevational view of the tool embodiment of FIG. 1.

One form of the mechanical tool, generally denoted 10, of the present invention is depicted in FIGS. 1–3. Tool 10 includes a handle portion 12 and two substantially opposed, spaced branches **14*a* & 14*b* extending from one end 13 thereof. As shown, handle 12 preferable has a T-shaped construction, which allows increased torque to be easily applied to a fitting or cap as described further below. Branches 14*a* & 14*b* extend from end 13 of handle 12 via angled portions 15*a* & 15*b*, respectively. The branches are substantially parallel and spaced apart a distance "d", which is roughly equal to the outer diameter of the drain cap or hose fitting to be manipulated. For example, most drain assemblies for recreational vehicles are three to four inches in diameter. Because of the adjustment capabilities of tool 10**, the tool may be used for drain assemblies which are either three or four inches in diameter.

Figure 5:
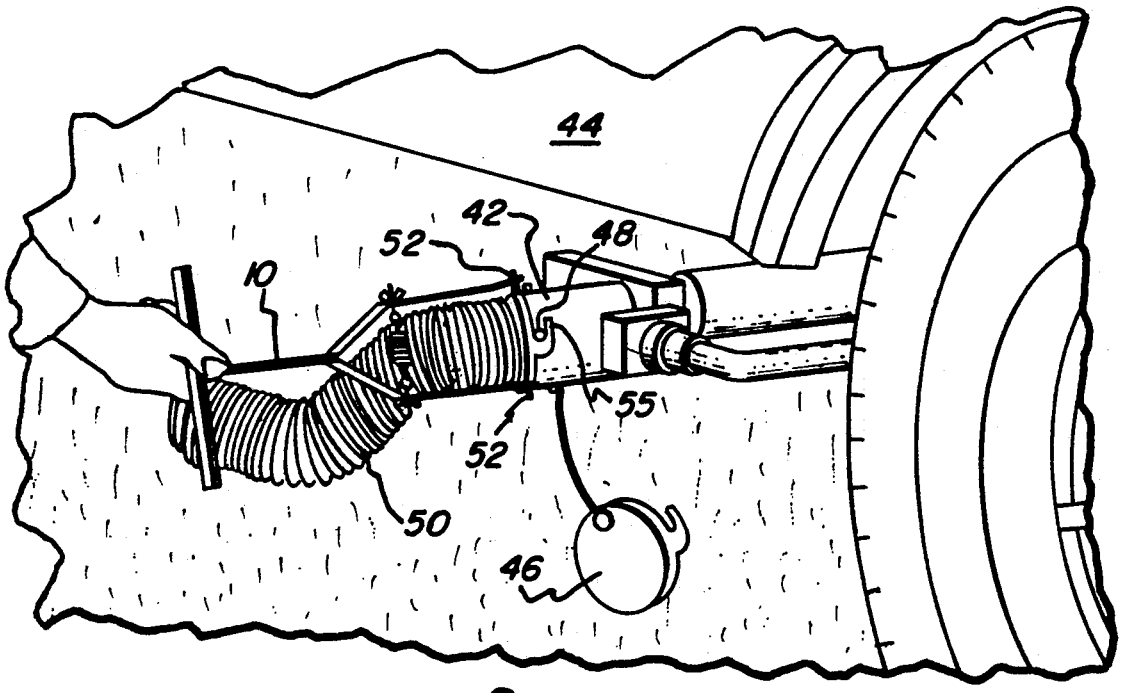
FIG. 5 is a perspective view of the tool embodiment of FIGS. 1–3 being used to connect a drain hose fitting to the drain outlet of a recreational vehicle.

The substantially opposed portions of branches **14*a* & 14*b* are of a sufficient length "l" to enable tool 10 to be used to connect a drain hose to the permanent drain outlet on the underside of a recreational vehicle. This operation is discussed below with reference to FIG. 5. The branches are interconnected by a tensioning member, generally denoted 16, which in the embodiment depicted comprises an adjustable spring assembly. The adjustable assembly has a spring 18 which connects at each end 19*a* & 19*b*, via loops 20, to a conventional eye bolt 22. Eye bolts 22 pass through a respective opening in branches 14*a* & 14*b*. The spring is tensioned at each end by tightening wing nuts 26 threadably secured to the ends of eye bolts 22 on the outside of branches 14*a* & 14*b***.

The free ends **30*a* & 30*b* of branches 14*a* & 14*b*, respectively, each contain a slot 32*a* & 32*b* therein which is sized to engagably receive one of the diametrically positioned lugs on the outer circumference of the hose fitting or drain cap to be connected or disconnected to the drain outlet. These uses will now be discussed with reference to FIGS. 4 & 5**.

Figure 4:
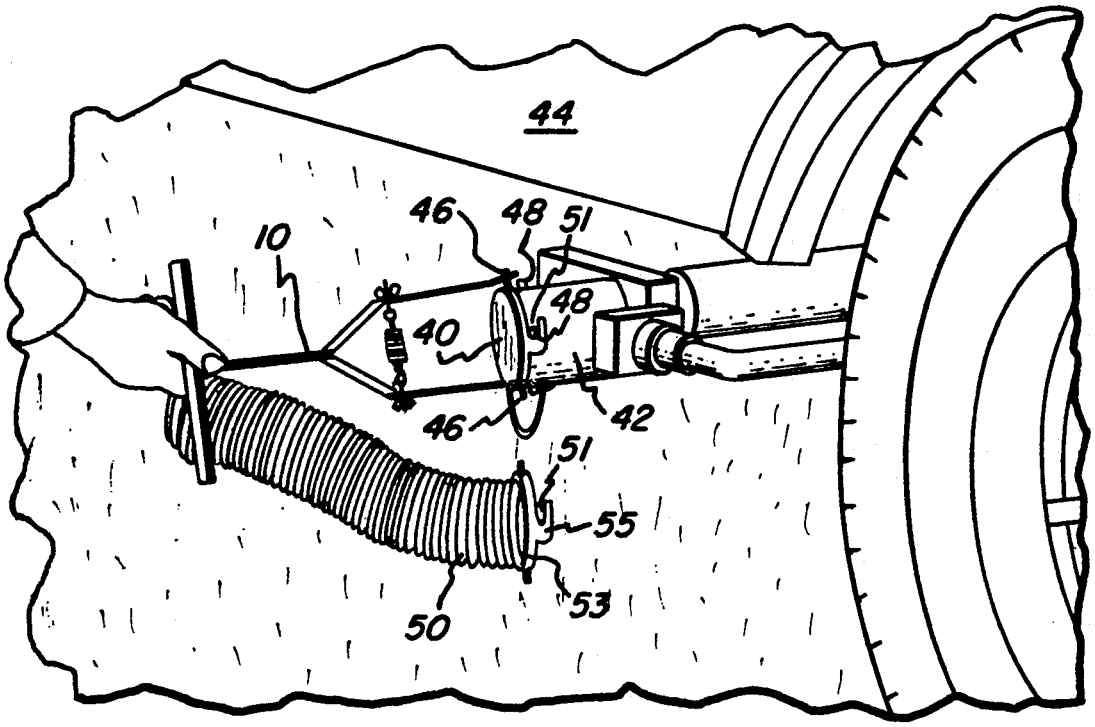
FIG. 4 is a perspective view of the tool embodiment of FIGS. 1–3 being used to uncouple the drain cap from the drain outlet of a recreational vehicle.

In operation, tool 10 is initially used to remove the drain cap 40 from the drain outlet 42 of a recreational vehicle 44 (see FIG. 4). Cap 40 has two substantially diametrically opposed lugs or ears 46 which are engagably received within slots 32*a* & 32*b* of tool 10. The ends 30*a* & 30*b* of tool 10 are flared outward to prevent the tool from binding on lugs 48 spacedly positioned about the circumference of drain outlet 42 at its outer end. Lugs 48 are typically symmetrically positioned about the drain outlet and are sized to be engagably received within slots 51 formed on the abutting side of cap 40 or drain hose fitting 50. Once positioned over lugs 46 of cap 40, a user may readily adjust, i.e. if necessary, wing nuts 26 to tension inwardly branches 14*a* & 14*b* and thereby securely engage the cap for manipulation.

After removing cap 46 from outlet 42, drain hose 50 may be readily lifted using tool 10 by positioning lugs 52 within slots 32*a* & 32*b* of the tool and again, if necessary, adjusting the tension on spring 18 via wing nuts 26. A simple clockwise torque applied to tool 10 will result in hose fitting 53 being securely fastened about lugs 48 of outlet 42 via hooks 55.

It will be noted from the above description that the present invention encompasses the features initially set forth herein. Specifically, tool 10 is sized to allow an operator to easily connect/disconnect the cap or hose fitting relative to the drain outlet of a recreational vehicle without being positioned under or fully reaching under the vehicle. Further, the hose fitting and cap may be manipulated without requiring the operator to physically handle the fitting or cap. The tool also facilitates the easy application of turning pressure to the fitting or cap.

While the invention has been described in detail herein in accordance with a certain preferred embodiment thereof, many modifications and changes therein may be effected by those skilled in the art. Accordingly, it is intended by the appended claims to cover all such modifications and changes as fall within the true spirit and scope of the invention.

What is claimed is:

1. A mechanical tool for manipulating from a coaxial direction a hose fitting or cap having two circumferentially positioned, substantially diametrically opposed outwardly projecting lugs, the hose fitting having a hose connected thereto, said tool comprising:

a handle;

said handle having two elongate resilient branches extending from one end thereof, a free end of each branch having an opening therein, said branches being spaced and said openings being sized such that said openings engagably receive a respective one of said cap or fitting lugs when said tool is oriented coaxially to and positioned in contact with one of the cap and hose fitting, said branches being sufficiently elongate to accommodate therebetween a sufficient portion of said hose to allow the tool to engage the hose fitting from a coaxial direction; and adjustable biasing means disposed between and connected to said branches for adjusting the resiliency of and distance between said branches, said adjustable biasing means being located between said one end of said handle and said free ends of said branches, said biasing means being disposed so as not to interfere with the use of said tool in manipulating the hose fitting or cap from a coaxial direction, said adjustable biasing means allowing said branches to be tensioned to securely engage said fitting or cap when in use and to adjust to engage hose fittings and caps of different diameters.

2. The mechanical tool of claim 1, wherein said handle has a T-shape configuration.

3. The mechanical tool of claim 1, wherein said branches are of substantially equal length and said length is greater than 10 inches.

4. The mechanical tool of claim 1, wherein said adjustable biasing means includes a spring disposed between said branches and means interconnecting said spring and said branches for adjusting the tension on said spring to thereby simultaneously modify the resiliency of said branches, and the distance therebetween.

5. The mechanical tool of claim 1, wherein the fitting and cap connect to and disconnect from a drain outlet and wherein the outlet comprises a septic drain outlet on a recreational vehicle.

6. The mechanical tool of claim 1, wherein said openings in the free ends of said branches comprise slots and wherein the free ends of said branches flare outward.

7. The mechanical tool of claim 6, wherein said outlet contains lugs circumferentially positioned thereabout and said flared free ends are sized to pass over said outlet lugs without catching.

* * * * *